US007078636B1

(12) United States Patent
Kao

(10) Patent No.: US 7,078,636 B1
(45) Date of Patent: Jul. 18, 2006

(54) SAFETY SWITCH FOR A PORTABLE STOVE

(75) Inventor: Chin-Hsiung Kao, Tucheng (TW)

(73) Assignee: Rekrow Industrial Inc., Tucheng (TW)

( * ) Notice: Subject to any disclaimer, the term of this patent is extended or adjusted under 35 U.S.C. 154(b) by 0 days.

(21) Appl. No.: 11/101,406

(22) Filed: Apr. 8, 2005

(51) Int. Cl.
*H01H 9/06* (2006.01)

(52) U.S. Cl. ..... 200/61.86; 200/61.85

(58) Field of Classification Search ..... 200/61.85, 200/566, 318, 321, 322
See application file for complete search history.

(56) References Cited

U.S. PATENT DOCUMENTS 5,607,611 A * 3/1997 Lee ..... 219/702
6,900,406 B1 * 5/2005 Huber ..... 200/566
2005/0023115 A1 * 2/2005 Vieira ..... 200/39 R
2005/0034967 A1 * 2/2005 Huber ..... 200/566

* cited by examiner

*Primary Examiner*—Michael Friedhofer
*Assistant Examiner*—Lisa Klaus
(74) *Attorney, Agent, or Firm*—Birch, Stewart, Kolasch & Birch, LLP

(57) ABSTRACT

The present invention discloses a safety switch for a portable stove, which controls the startup of an ignitor as well as an adjusting rod to adjust the flame. By latching an end of a push button into a limit groove disposed above an installing hole, the invention assures the stove to be turned off completely to prevent a fuel leak. With a gap between the push button and the installing hole, a knob can be turned to drive the adjusting rod to adjust the quantity of incoming airflow of the fuel. If a pressing rod is pressed to start the ignitor, the knob and the push button will not move back and forth accordingly, so that the push button will not be worn out so easily but can maintain its longevity.

8 Claims, 9 Drawing Sheets

SAFETY SWITCH FOR A PORTABLE STOVE

FIELD OF THE INVENTION

The present invention relates to a safety switch, and more particularly to a safety switch for a portable stove.

BACKGROUND OF THE INVENTION

In general, a switch for a portable stove is turned to control the stove according to a user's feel. However, it is very difficult to determine whether or not the switch is turned tight enough. As a result, a fuel leak may occur due to user's negligence, or if the switch is not turned tight enough. To solve the problem, a fire protection device is used to assure the stove fire to be turned off completely so as to prevent a fuel leak.

Referring to FIG. 1 for a prior art fire protection device 100, the fire protection device 100 installs a push-button switch 120 with an accommodating groove 121 disposed into a cylindrical hollow button holder 110 and uses a spring 122 and a fixing axle 123 to install a pressing member 124 into the accommodating groove 121, such that a rear end of the pressing member 124 is latched with a limit groove 111 an opening of the button holder 110. If the pressing member 124 is pressed to turn the push-button switch counterclockwise and the adjusting rod 130 is turned out of an adjusting hole 161, then the fuel will be discharged along a continuous path of a fuel holder 150, a flame nozzle holder 160 and a flame nozzle 170. Since the push-button switch 120 has a propping section 125 disposed at the end of the push-button switch 120, therefore the push-button switch 120 can start an ignitor 140 when pressed.

Although the fuel can be shut down completely without the risk of a fuel leak by latching the rear end of the pressing member 124 with the limit groove 111, the pressing member 124 will drive the push-button switch 120 to rotate counterclockwise when the pressing member 124 is pressed as shown in FIGS. 2A and 2B. The front end of the pressing member 124 and the limit section 126 coupled with its recession 112 will be rotated repeatedly to produce a friction with the internal wall of the button holder 110. If it is necessary to start the ignitor 140 or press the push-button switch 120, the surface of the pressing member 124 produces a friction with the internal wall of the button holder 110 which will wear out the pressing member 124 easily, because the pressing member 124 is fixed onto the push-button switch 120.

SUMMARY OF THE INVENTION

The primary objective of the present invention is to provide a safety switch for a portable stove, such that when the switch is pressed to start the ignition, the component will not be worn out easily due to the pressing action, and also prevent children from turning on the switch and igniting the stove easily.

To achieve the foregoing objective, a preferred embodiment of the present invention comprises a pressing rod, a coupling device, a knob, a push button and an installing hole disposed on a lateral side of a portable stove. The pressing rod is disposed at an external side of an adjusting rod for adjusting the flame, and one end of the adjusting rod is coupled with an adjusting hole of a flame nozzle holder, and the surface on another end comprises a plurality of first convex teeth, and each convex tooth alternately corresponds to each second convex tooth in the pressing rod, and thus the pressing rod can slide back and forth with respect to the adjusting rod, and the propping member disposed at the rear end of the pressing rod presses the ignitor for an ignition. The coupling device is fixed onto the surface of the pressing rod, and a plurality of third convex teeth disposed on the surface of the coupling device alternately correspond to a plurality of fourth convex teeth disposed in the knob. The knob is disposed at the external side of the pressing rod, and the pressing rod can slide back and forth with respect to the pressing rod, and the rotation of the knob also can drive the pressing rod to rotate the adjusting rod, and thus adjust the flow of the fuel.

By latching the rear end of the push button disposed on the knob constantly with the limit groove of the body of the safety switch, the stove fire can be shut down completely, and thus achieve the objectives of preventing children to ignite the stove easily. Further, if the push button is pressed to be turned counterclockwise, the pressing rod and adjusting rod are driven to rotate to separate the adjusting rod from the adjusting hole and discharge the fuel. When the push button is pressed, a gap is maintained between the rear end of the push button and the installing hole, and thus the push button will not be worn out when the knob is rotated. After the fuel is discharged and the pressing rod is pressed to start the ignitor, the pressing rod can slide back and forth with respect to the adjusting rod, since the first convex tooth corresponds to the second convex tooth in the pressing rod, so that the propping member disposed at the rear end of the pressing rod presses the ignitor for an ignition. The push button will not be worn out as the pressing rod is moved, and thus having the advantage of maintaining its longevity.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
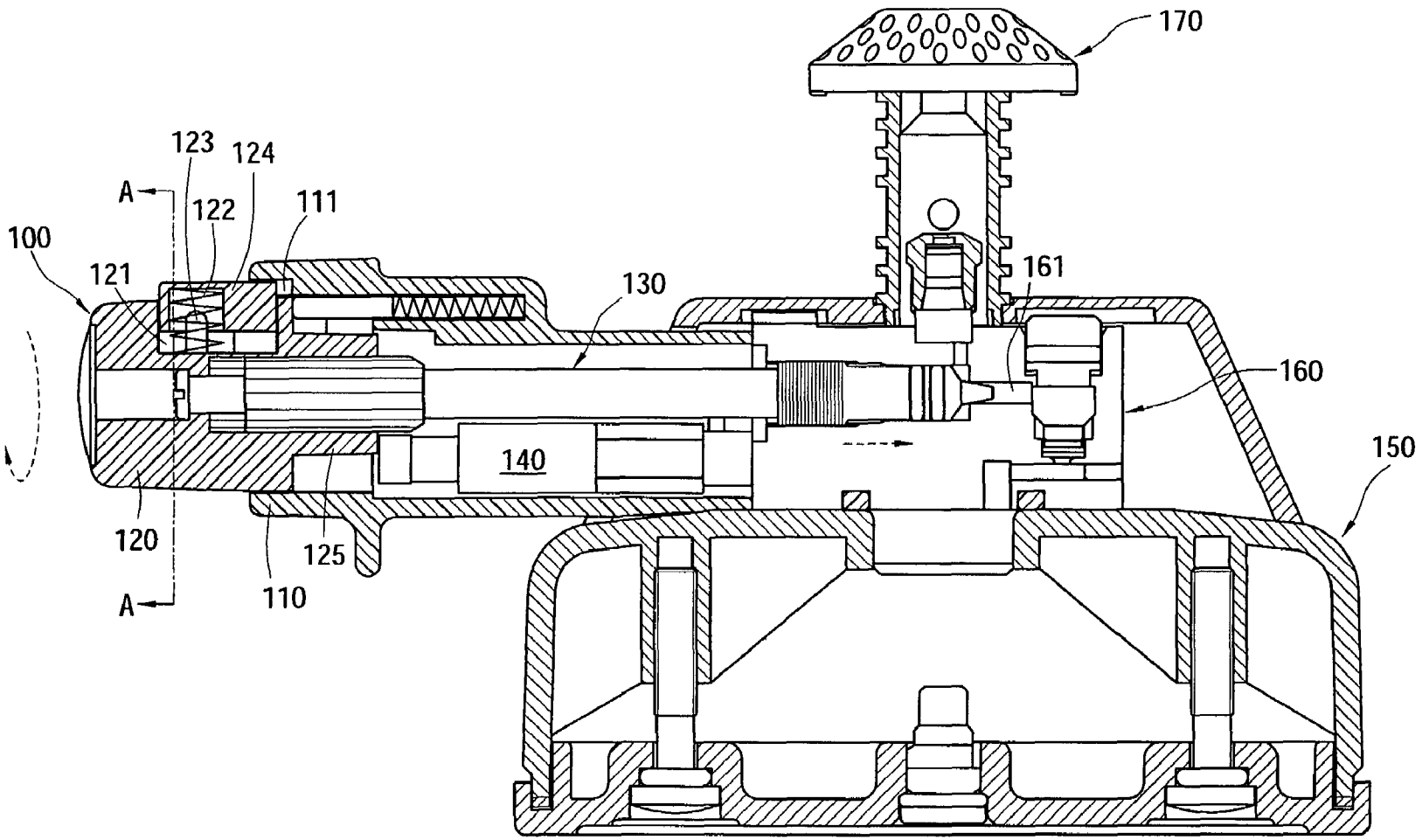
Fig.1 PRIOR ART
FIG. 1 is a cross-sectional view of a fire protection device of the prior art portable stove.
Figure 2B:
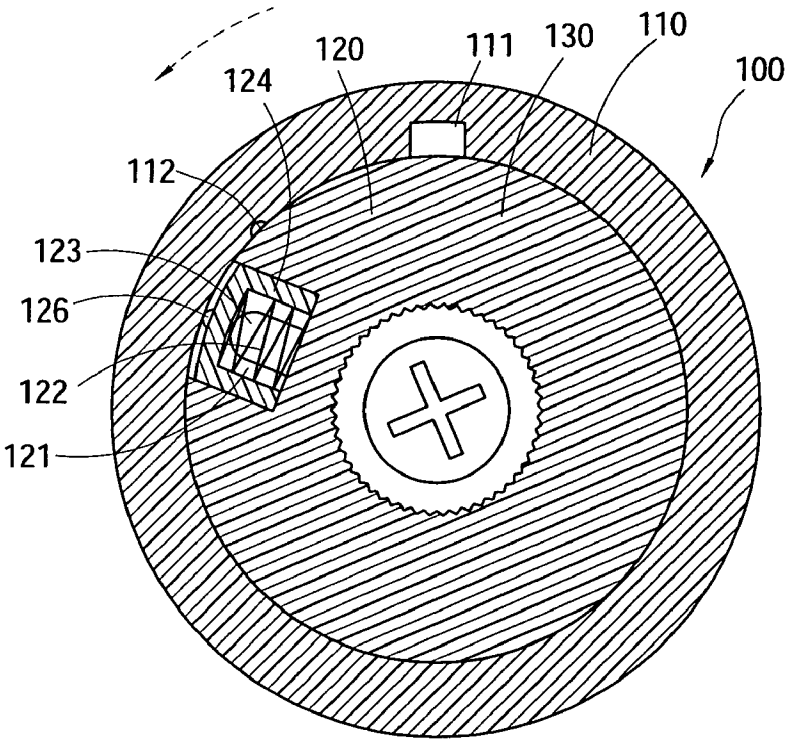
Fig.2B PRIOR ART
FIGS. 2A and 2B are cross-sectional views of Section A—A as depicted in FIG. 1.
Figure 2A:
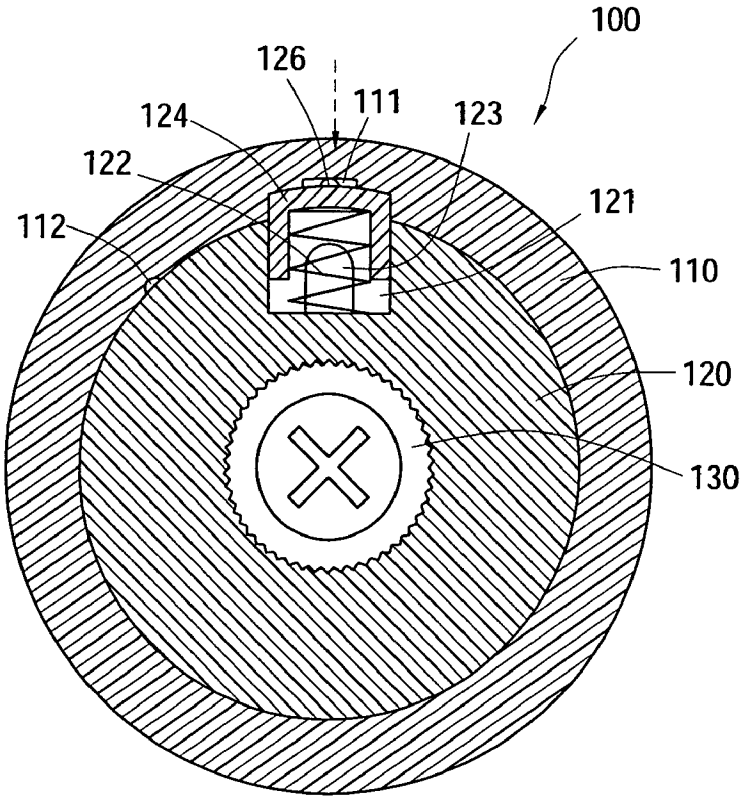
Fig.2A PRIOR ART
Figure 3:
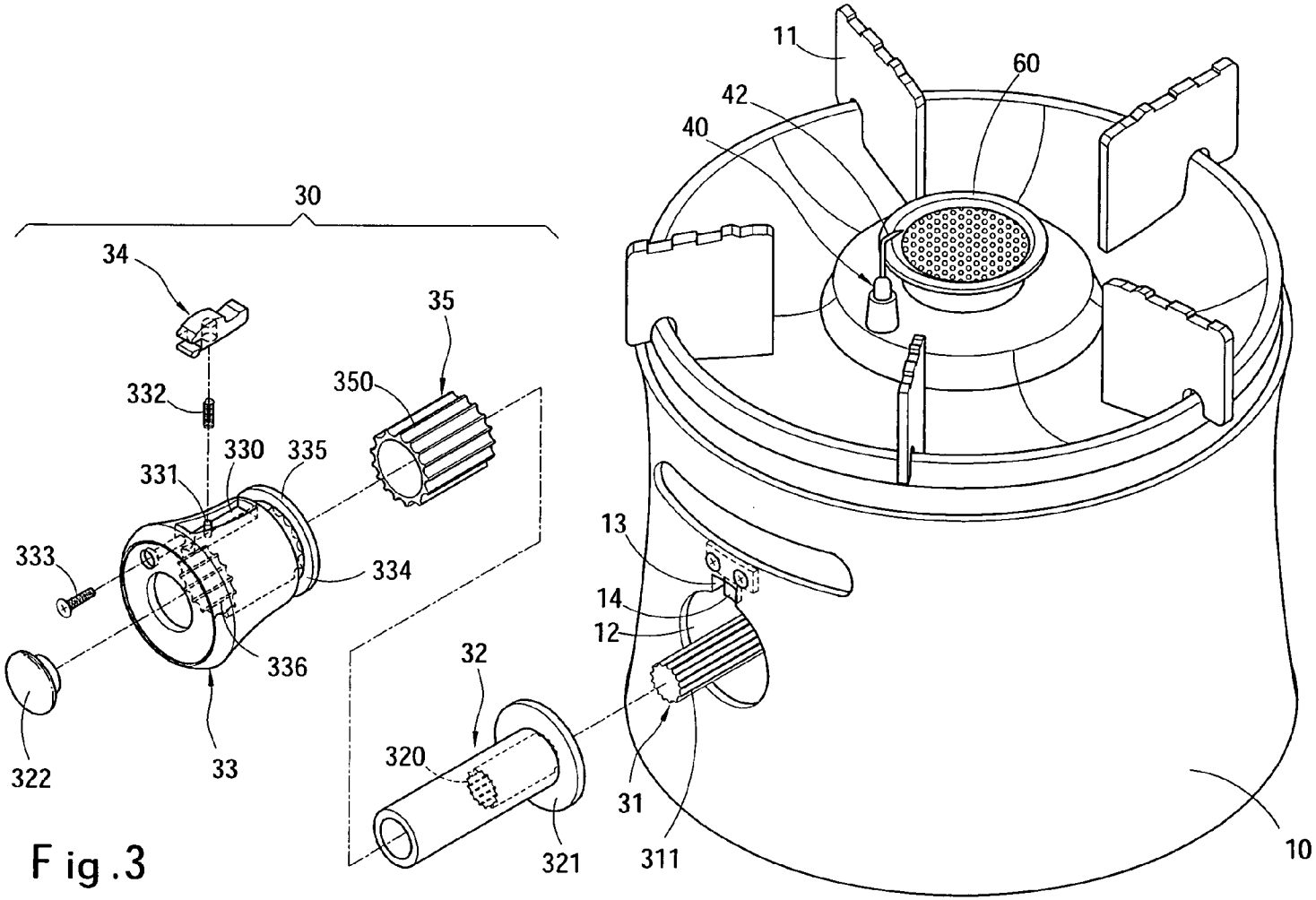
FIG. 3 is a perspective view of a safety switch for a portable stove according to a preferred embodiment of the present invention.
Figure 4A:
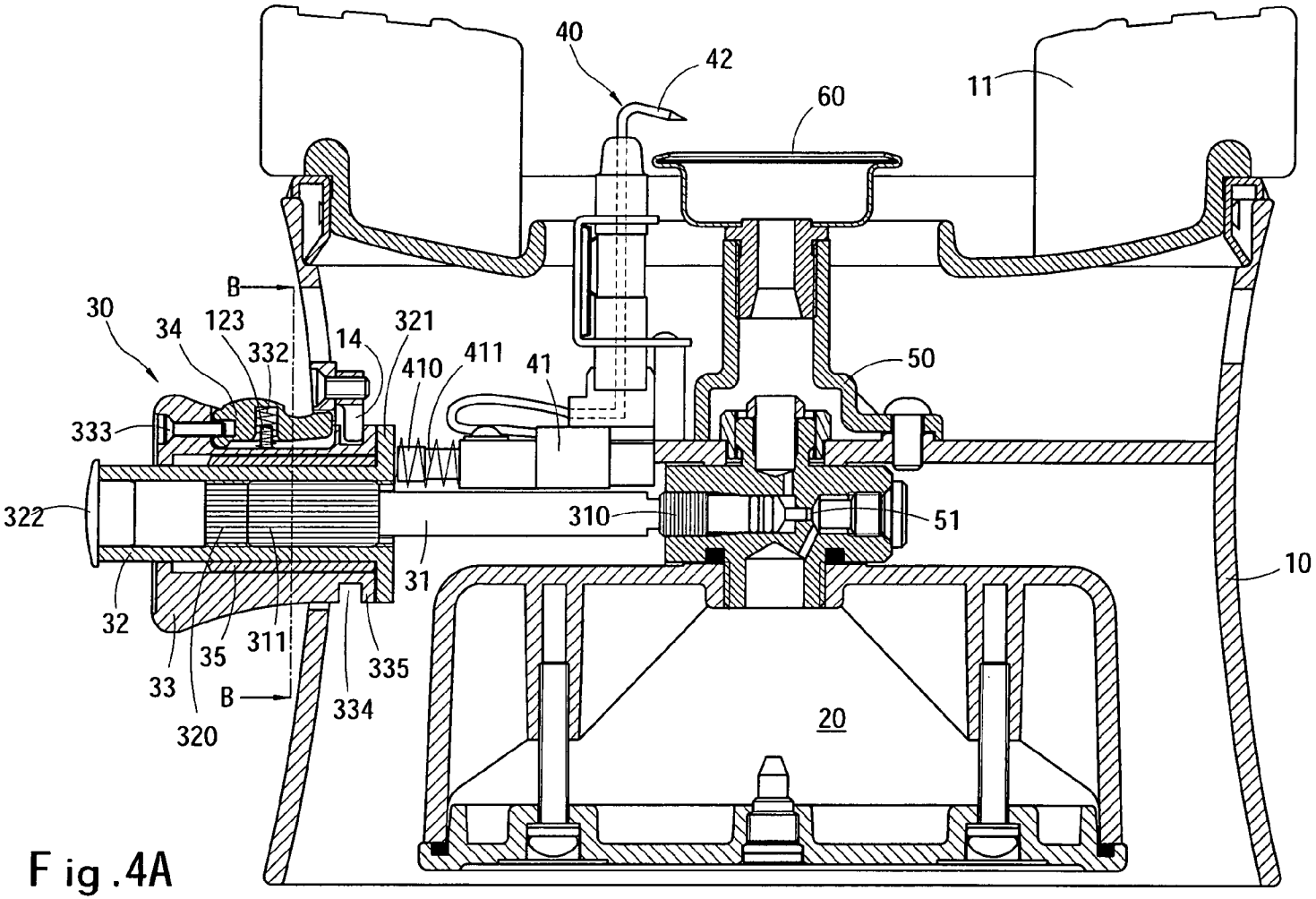
FIGS. 4A to 4D are lateral cross-sectional views of a safety switch for a portable stove according to a preferred embodiment of the present invention.

Referring to FIGS. 3 and 4A, a perspective view and a lateral cross-sectional view of a safety switch 30 for a portable stove are illustrated respectively. The safety switch 30 comprises a body 10, a fuel holder 20, a safety switch 30, an electronic ignitor 40, a flame nozzle holder 50 and a flame nozzle 60. The body 10 includes a stove rack 11 disposed thereon for placing an object waiting to be heated. The fuel holder 20 is installed at the bottom of the body 10 for storing fuel. The flame nozzle holder 20 is mounted onto the top of the fuel holder 20 for upwardly connecting a flame nozzle 60 and defining a continuous passage, such that the fuel can be discharged from the flame nozzle 60. Further, the electronic ignitor 40 includes an ignitor 41 and an electrode 42, and the ignitor 41 is started by the safety switch 30 disposed at the rear end, such that the electrode 42 produces a spark by an electric discharge phenomenon, and its detail actions will be described as follows.

The safety switch 30 for a portable stove installed at an installing hole 12 on one side of the body 10 comprises a pressing rod 32, a knob 33, a push button 34, and a coupling device 35 for controlling the startup of the ignitor 41 and controlling an adjusting rod 31 to adjust the flame. One end of the adjusting rod 31 is latched into an adjusting hole 51 of the flame nozzle holder 50. A thread section 310 of the adjusting rod 31 is coupled with the flame nozzle holder 50. The adjusting rod 31 has a plurality of first convex teeth 311 disposed at another end and protruded out from the installing hole 12 of the body 10. The pressing rod 32 comprises a plurality of second convex teeth 320 disposed on the internal side, such that the second convex teeth 320 alternately correspond to the first convex teeth 311. The pressing rod 32 is coupled to the external side of the adjusting rod 31, and the pressing rod 32 will slide back and forth with respect to the adjusting rod 31 due to the design of the first convex teeth 311 and the second convex teeth 320. Further, the pressing rod 32 comprises a propping section 321 disposed at the rear end, and the rear end of the propping section 321 presses against the pressing section 410 of a spring 411 disposed at an end of the ignitor 41. The propping section 321 is driven to move inwardly by pressing the pressing rod 32, and thus the pressing section 410 of the ignitor 41 is pressed to start the ignitor 41. If the pressing rod 32 is released, then the pressing rod 32 is resumed to its original position by the resilience of the spring 411. The coupling device 35 is fixed to the external side of the pressing rod 32, and the coupling device 35 has a plurality of third convex teeth 350 at its surface, and the third convex teeth 350 alternately correspond with a plurality of fourth convex teeth 336 disposed at the internal side of the knob 33. The knob 33 is coupled to the external side of the pressing rod 32 for sliding the pressing rod 32 back and forth with respect to the knob 33. The knob 33 is turned to link and drive the pressing rod 32 and the adjusting rod 31 to rotate, and thus change the relative positions of the adjusting rod 31 and the adjusting hole 51. The knob 33 has an accommodating groove 330 disposed thereon, and the push button 34 is installed into the accommodating groove 330 through a positioning axle 331 at the top of the accommodating groove 330 and the spring 332 is coupled to the top of the positioning axle 331 and then fixed onto the knob 33 by a fixture 333. A rear end of the push button 34 has a limit groove 13 disposed and latched with the installing hole 12. Since the length of the pressing rod 32 is larger than that of the knob 33, therefore an end of the pressing rod 32 is protruded out from a side of the knob 33, and a cover 322 covers the front end of the pressing rod 32. The knob 33 at its rear end has a circular groove 334 and a latch section 335, and the knob 33 is latched to the groove 334 by a latch 14 disposed at the cop of the installing hole 12, such that the knob 33 will not be moved back and forth. However a gap is maintained between the latch 14 and the groove 334, so that the knob 33 still can be rotated.

Figure 4B:
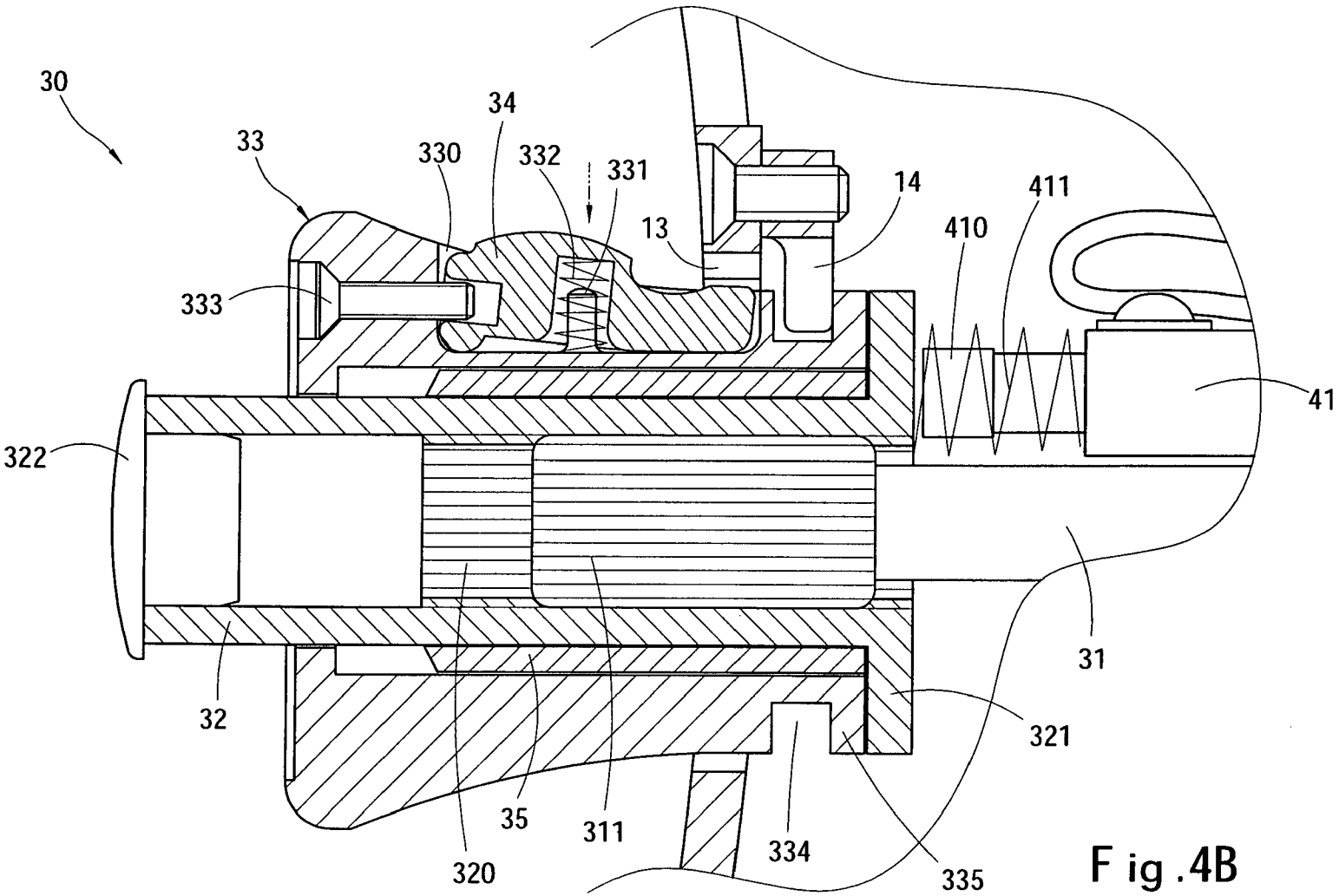
Figure 4C:
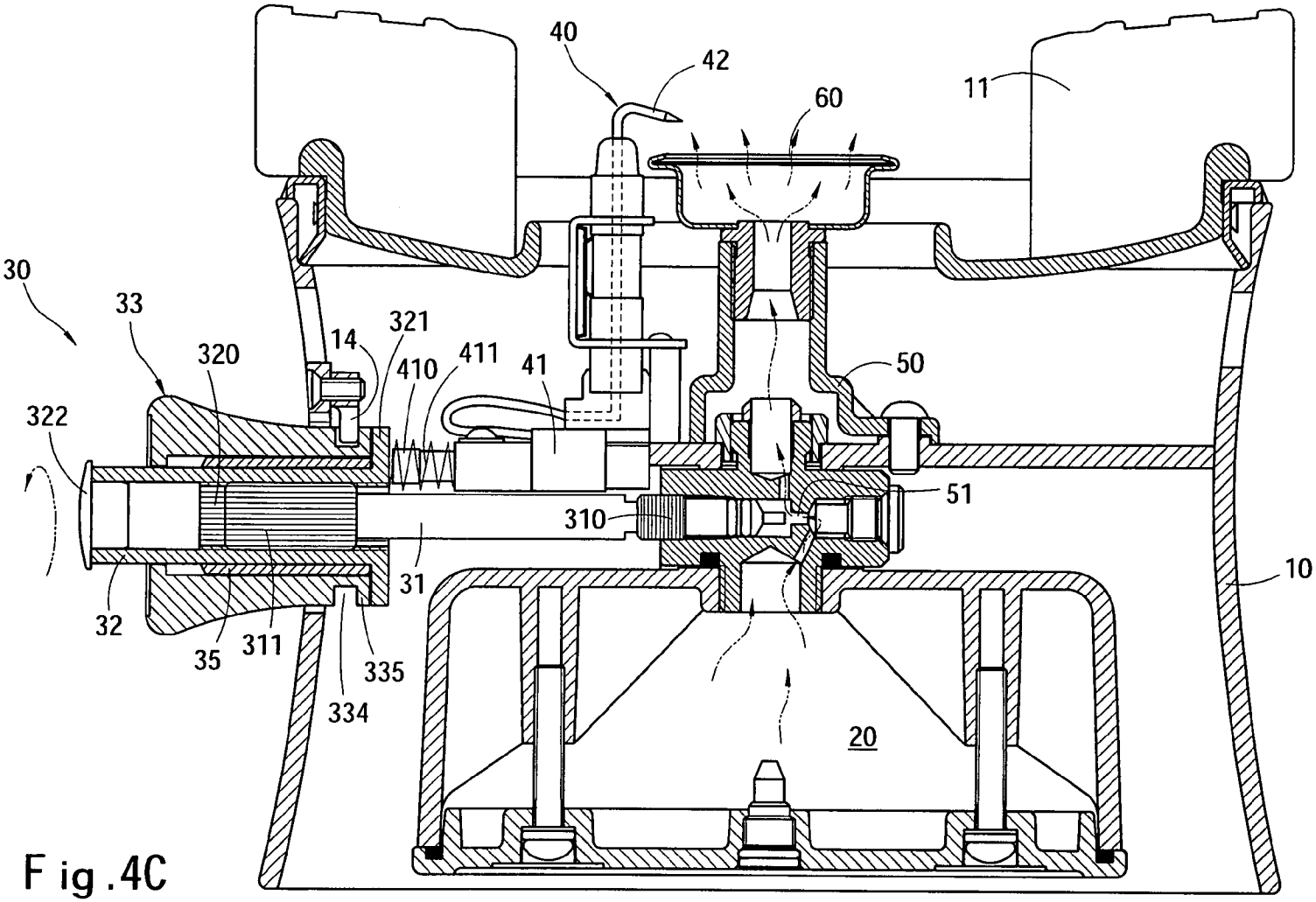
Figure 4D:
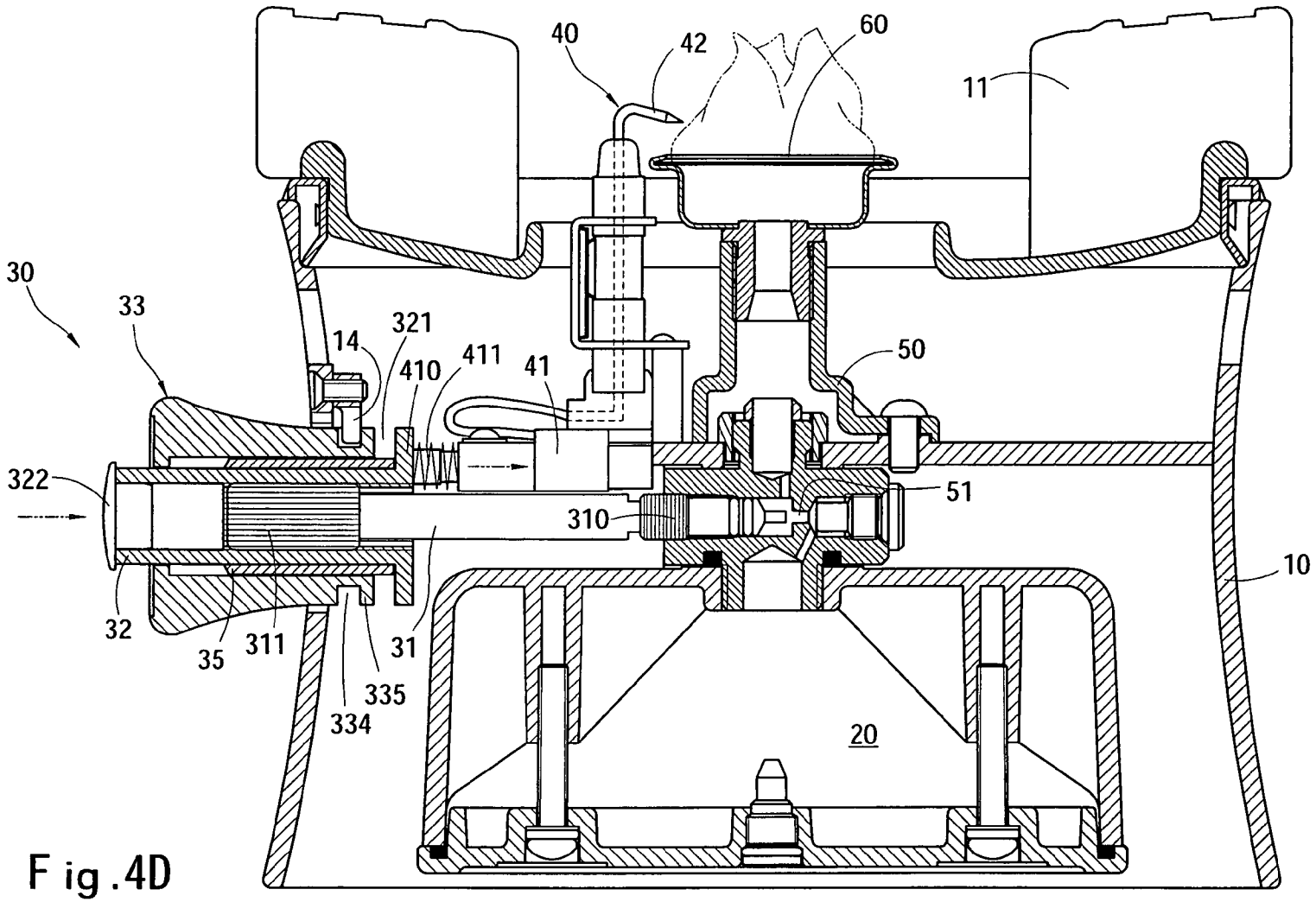
Figure 5B:
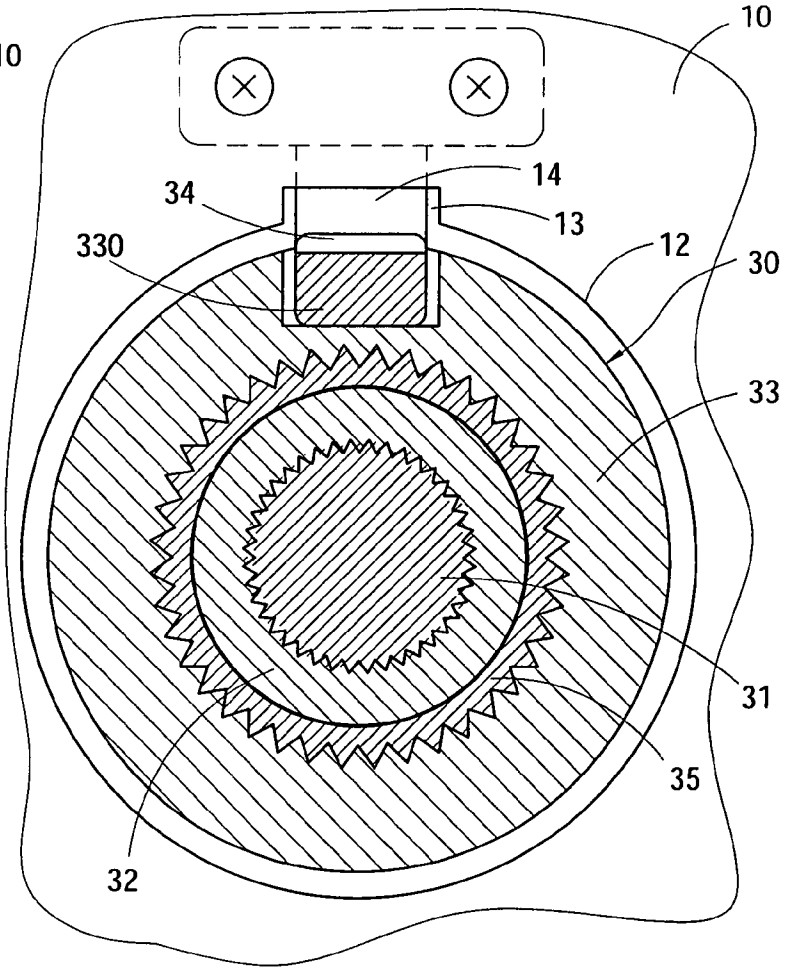
FIGS. 5A to 5C are lateral cross-sectional views of Section B—B as depicted in FIG. 4A.
Figure 5A:
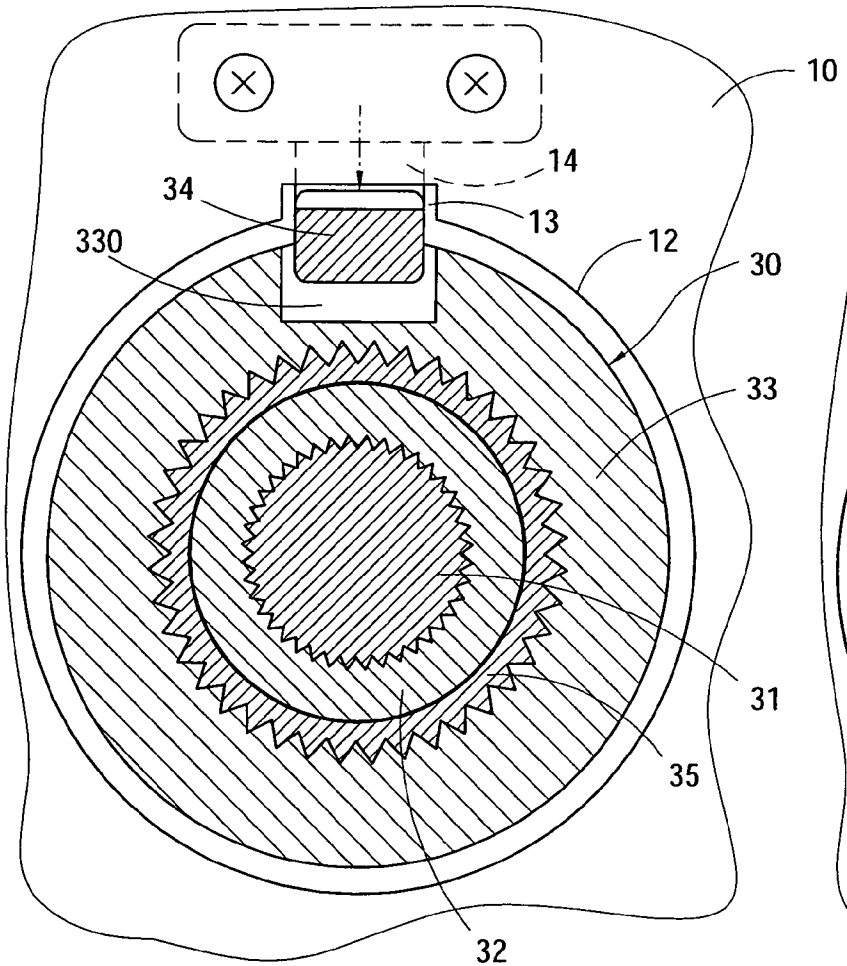
Figure 5C:
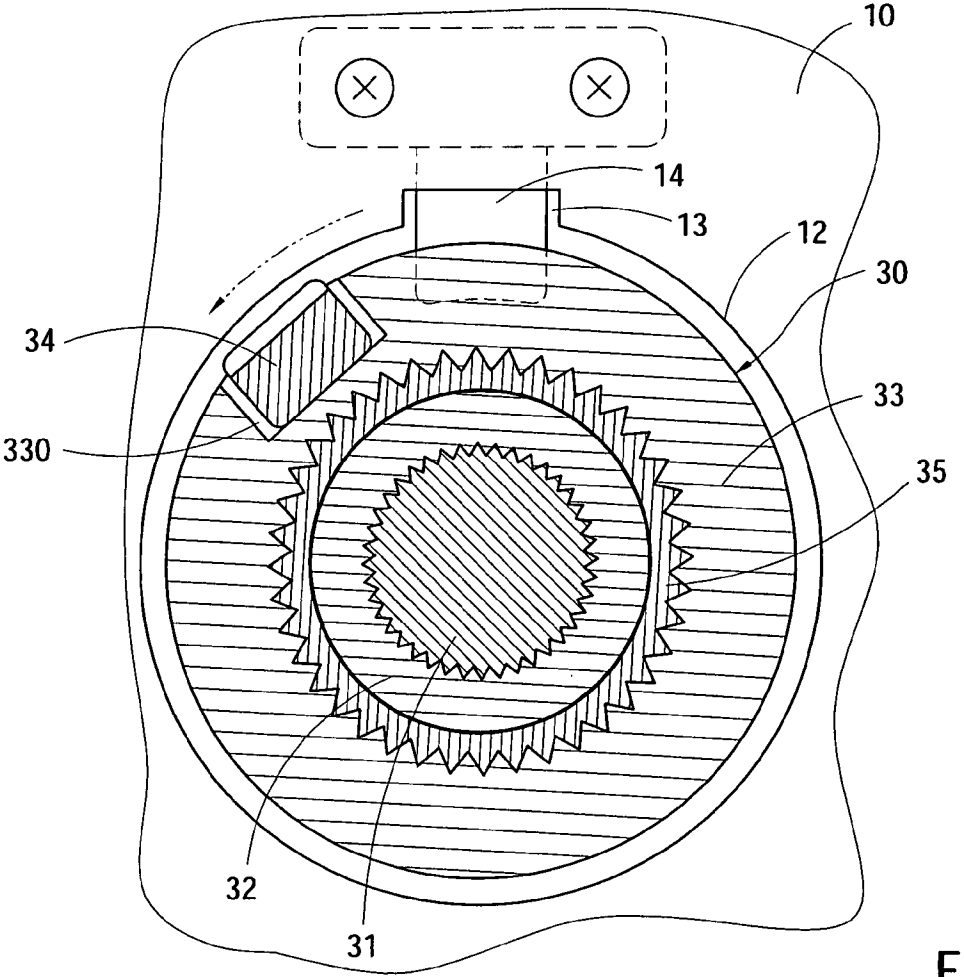

Referring to FIGS. 4A to 4D and 5A to 5D, the push button 34 is latched constantly in the limit groove 13 as shown in FIGS. 4A and 5A, before the push button 34 is pressed. By then, the front end of the adjusting rod 31 is latched into the adjusting hole 51 to block the passage of the fuel, so as to assure the complete shutdown of the safety switch for a portable stove. If it is necessary to start the stove, the push button 34 is pressed to separate the push button 34 from the limit groove 13 as shown in FIGS. 4B and 5B, and the knob 33 is turned counterclockwise as shown in FIGS. 4C and 5C, such that the knob 33 drives the coupling device 35 and the pressing rod 32 to rotate the adjusting rod 31, and the adjusting rod 31 is rotated out from the adjusting hole 51 to discharge the fuel out from the continuous passage of the fuel holder 20, the flame nozzle holder 50 and the flame nozzle 60. If the push button 34 is pressed to turn the knob 33, the rear end of the push button 34 originally latched into the limit groove 13 is separated from the limit groove 13 and moved counterclockwise according to the knob 33 (or building a thread section 310 at the rear side of the adjusting rod 31 to change the turning direction clockwise). After the fuel is discharged and the pressing rod 32 as shown in FIG. 4D is pressed at the position of the cover 322, the pressing rod 32 can slide backward with respect to the adjusting rod 31 due to the design of the alternate correspondence of the second convex teeth 320 with the first convex teeth 311, so that the propping section 321 can press the pressing section 410 to start the ignitor 41 and the electrode 42 produces a spark to light up the flame nozzle 60 and ignite the stove fire. If it is necessary to turn off the stove, the push button 34 is pressed to rotate the knob 33 clockwise, such that the adjusting rod 31 is moved towards the adjusting hole 51. If the push button 34 is released, the spring 332 acts on the push button 34 to return the push button 34 to the limit groove 13 as shown in FIG. 4A to achieve the objective of completely shutting down the stove fire and prevent children to turn on the stove easily.

In summation of the above description, the present invention herein enhances the performance than the conventional structure and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A safety switch for a portable stove, said safety switch being installed at an installing hole of said portable stove for controlling the startup of an ignitor and controlling an adjusting rod to adjust a flame, and said safety switch comprising:

a pressing rod, having a second convex tooth coupled to said adjusting rod and a propping section disposed at a rear end of said pressing rod;

a coupling device, disposed at an external side of said pressing rod and having a third convex tooth disposed on a surface of said coupling device;

a knob, having a fourth convex tooth correspondingly coupled with said third convex tooth, and constructing an accommodating groove; and a push button, installed into said accommodating groove of said knob, and said push button being a control switch of said knob.

2. The safety switch for a portable stove of claim 1, wherein said push button is coupled onto said knob by a fixture.

3. The safety switch for a portable stove of claim 1, wherein said knob at its rear end includes a groove and a latch section.

4. The safety switch for a portable stove of claim 1, wherein said installing hole further installs a latch at the top of said installing hole for latching said groove to fix the front and rear positions of said knob.

5. The safety switch for a portable stove of claim 1, wherein said adjusting rod includes a first convex tooth on its surface.

6. The safety switch for a portable stove of claim 5, wherein said first convex tooth shifts in parallel with said second convex tooth.

7. The safety switch for a portable stove of claim 1, wherein said third convex tooth shifts in parallel with said fourth convex tooth.

8. The safety switch for a portable stove of claim 1, wherein said installing hole installs a limit groove at its top and the rear end of said push button is latched to said limit groove.

* * * * *